United States Patent [19]

DeVilliers

[11] 4,016,730

[45] Apr. 12, 1977

[54] REFRIGERATORS

[76] Inventor: Paul Hendrik DeVilliers, 224 Anderson St., Pretoria, South Africa

[22] Filed: Jan. 31, 1975

[21] Appl. No.: 546,142

[30] Foreign Application Priority Data

Feb. 5, 1974 South Africa ..... 74/0741

[52] U.S. Cl. ..... 62/476; 62/239; 98/79; 126/85 B

[51] Int. Cl.[2] ..... F23B 15/00; F23L 17/02

[58] Field of Search ..... 62/497, 239, 476; 126/85 B, 99 D, 307 A, 307 R; 98/78, 79, 83, 119; 237/28, 30–33; 431/157

[56] References Cited

UNITED STATES PATENTS

| | | | |
|---|---|---|---|
| 119,885 | 10/1871 | Roth | 98/78 |
| 2,755,794 | 7/1956 | Wendell | 126/307 R |
| 3,168,091 | 2/1965 | Jackson | 126/85 B |
| 3,295,334 | 1/1967 | Hultgren | 62/497 |
| 3,302,552 | 2/1967 | Walsh | 98/78 |
| 3,347,147 | 10/1967 | Howard | 98/78 |
| 3,693,610 | 9/1972 | Ehrlichman | 126/85 B |

FOREIGN PATENTS OR APPLICATIONS

| | | | |
|---|---|---|---|
| 757,185 | 10/1933 | France | 98/83 |
| 409,960 | 6/1945 | Italy | 98/78 |

*Primary Examiner*—Carroll B. Dority, Jr.
*Attorney, Agent, or Firm*—Millen & White

[57] ABSTRACT

An improvement in refrigerators of the absorber type in which heat from a flame circulates the refrigerant in the refrigerating cycle, particularly for use in caravans. To prevent the flame being extinguished in draughty conditions there is provided shielding means for protecting the flame, a flue extending from above the flame upwardly to an exit into ambient air, and means at the flue exit such as a venturi device adapted to provide a reduction of pressure from ambient air to the interior of the flue in draughty conditions of the ambient air. Preferably, the shielding means totally encloses the flame and is provided with an inlet connection pipe adapted to provide access for ambient air to the interior of the shielding means, the entrance to the inlet connection pipe having baffles and foils adapted to prevent any reduction of pressure from ambient air to the inlet connection pipe interior in draughty conditions of the ambient air. An ante chamber is preferably interposed in the inlet connection pipe and a moisture trap is preferably interposed in the flue.

12 Claims, 14 Drawing Figures

REFRIGERATORS

BACKGROUND OF THE INVENTION

The present invention relates to refrigerators of the absorber type, in which heat from a flame circulates the refrigerant in the refrigerating cycle. The invention is applicable particularly where such a refrigerator is used in a draughty environment, for example, for camping and in particular in caravans. Refrigerators of this type are usually operated with paraffin or petroleum gas as a fuel, the latter being preferred for use in caravans and in camping. Draughty conditions are inclined to interfere with the satisfactory operation of the refrigerator. The flame may become extinguished, or with satisfactory burning of the flame ventilation may be impeded to such an extent that the cooling effect is substantially reduced.

More commonly, trouble is due to the flame being extinguished, which can occur under draughty conditions in one or more of several ways. In addition to draughts directly blowing out the flame, the draughts may reverse the natural draught of the flue and "blow" the flame out, or the draughts may indirectly reduce air pressure at the flame burner means and so cause the air-fuel mixture to go outside the combustible ratio, or both effects may be present.

Some constructions of absorber type of refrigerators endeavour to mitigate this problem by shielding the burner means itself against draught. However, this alone is not always adequate to solve the problem.

SUMMARY OF THE INVENTION

An absorber type refrigerator having a burner means adapted to burn a fuel with air in accordance with this invention comprises shielding means adapted to inhibit adverse effects of draughts upon the burner means and a flue leading upwards from the burner means, the upper exit of the flue to ambient air being provided with means adapted to provide a reduction of pressure from ambient air to the flue interior in draughty conditions of the ambient air.

Preferably the shielding means is adapted to substantially totally enclose the burner means and is provided with inlet connection means adapted to provide access for ambient air to the interior of the shielding means, the entrance to the inlet connection means having means adapted to prevent any reduction of pressure from ambient air to the inlet connection means interior in draughty conditions of the ambient air. This pressure reduction preventing means can comprise foils and/or baffles located at the entrance and adapted to prevent a predominant component of air velocity from arising in a direction normal to a direction of air flow into the connection means so as to at least prevent a venturi-action originated pressure reduction from ambient air to connection means interior. The pressure reduction preventing means can alternatively comprise a truncated hollow cone located at the entrance to the inlet connection means, or other means having the same effect.

A further refinement is preferably added, namely, an ante chamber is interposed between the connection means and the shielding means, being adapted to damp abrupt pressure changes transmitting from the ambient air to the interior of the shielding means.

A further preferred refinement is a water trap in the flue, adapted to trap moisture which may form in the flue and prevent it falling onto the burner means.

While the means at the exit of the flue can in principle be an extraction fan, more preferably it is a passive means, for example, means effecting a venturi action. Reasonable results are attainable with a fitting rotatably connected to the discharge end of the flue pipe, having an outlet aperture and a vane adapted to direct the outlet aperture automatically wind-downward. If such device is appropriately designed, the draught or wind blowing over such an outlet, will provide an adequate suction effect for the purposes of the invention. It will certainly prevent a back pressure in the flue. This is a reversed pitot tube in essence.

More preferred for the purpose of the invention are means which are more positively designed to create a pressure reduction effect at the outlet of the flue. Thus, in accordance with one preferred embodiment the outlet of the flue opens into the throat of a venturi, adapted to be suitably directed in respect of a draught or wind direction, so that such draught or wind passing through the venturi, will produce a pressure reduction effect at the outlet apertures of the flue. More particularly, the venturi device is also rotatably mounted, its direction being vane-controlled in a manner such as to ensure that the venturi turns to always direct the entrance to the venturi upwind.

Alternatively, there may be mounted on the top of the flue pipe as the outlet device thereof, pressure reduction domes designed for wind blowing thereover to apply pressure reduction to the outlet of the dome in accordance with known aerodynamic principles. An advantage of such a device is its simplicity, since it does not require moving parts for its operation.

When the refrigerator is mounted for example, in a caravan, it is usually advantageous to extend the conventional flue pipe of the refrigerator by an extension pipe passing, e.g. through the roof of the caravan or the like, to the top of which must then be fitted one or other of the aforesaid pressure reduction means. Because water vapour is in fact one of the products of combustion of fuels conventionally used in this context, it is advisable to provide in the flue extension pipe a suitable trap for collecting and discharging condensed water.

In accordance with the invention, care should be taken that the burner means itself is adequately shielded against draught. In some constructions of absorber type refrigerators, this may already be the case. In the case of other constructions, additional shielding means may be provided in a manner which require no special description.

BRIEF DESCRIPTION OF THE DRAWINGS:

This invention will be more fully described by way of example with reference to the accompanying drawings.

DESCRIPTION OF THE PREFERRED EMBODIMENTS

Figures 1, 2, 3, 4A, 4B, 5A, 5B, 6A, 6B, 7A, 7B, 8A, 8B, 9:
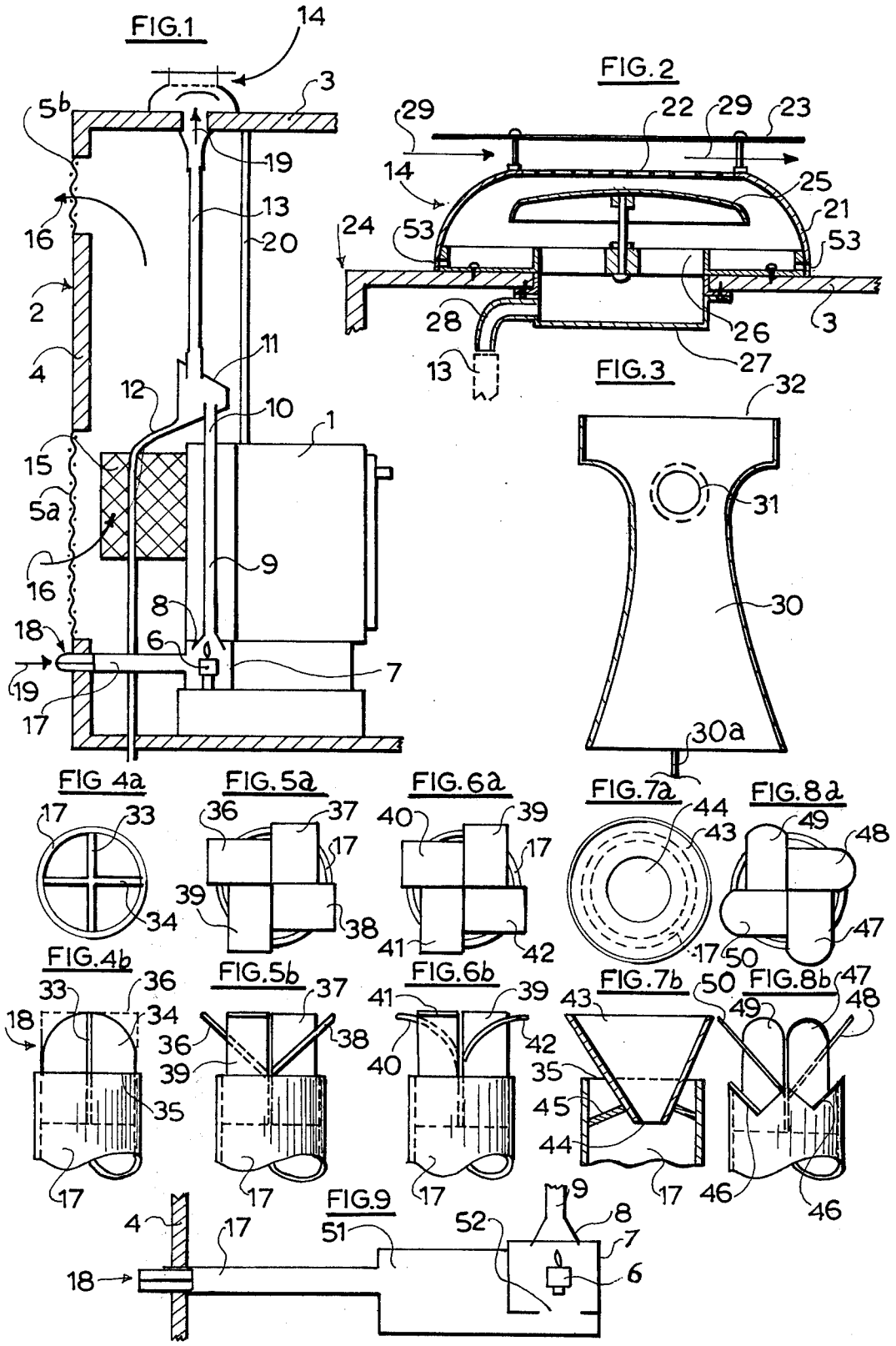
FIG. 1 is a cross-sectional elevation of an absorber-type refrigerator in accordance with the preferred embodiment of this invention installed in a caravan.
FIG. 2 is a cross-sectional elevation of a detail of the absorber type refrigerator shown in FIG. 1 on a larger scale.
FIG. 3 is a plan view of a horizontal section of a pivoted venturi means, which can alternatively be employed in the absorber type refrigerator according to the invention, FIGS. 4*a*, 4*b* through to FIGS. 8*a*, 8*b* are elevations and plan views respectively of alternative entrances to connection means adapted to provide access for ambient air to the interior of the burner shielding means.
FIG. 9 is a schematic sectional elevation showing an ante chamber incorporated in the connection means in accordance with the invention.

Referring to FIG. 1, the refrigerator 1 is mounted in substantially conventional manner in a caravan 2 having a roof 3 and a side wall 4. The side wall 4 in its region adjoining the refrigerator is provided with louvre-like venting means 5*a* and 5*b*. Cooling coils of the refrigerator 1 are schematically indicated by 15 and the arrows 16 indicate the natural cooling draught via louvres 5*a* and 5*b*, which cools the coils 15. Wall 20 excludes the draught indicated by arrows 16 from the caravan interior. The gas burner 6 of the refrigerator 1 is mounted in a box 7 (and is thus substantially shielded against draught) and underneath a hood 8 constituting the inlet end of a flue pipe 9. The flue pipe 9 is associated with various conventional means for heating the refrigerator medium with which the refrigerator operates, these means being not shown for the sake of simplicity.

The top end 10 of the flue 9 is directly connected to a water trap 11, having an outlet 12 for condensed water. The top of the trap 11 feeds into the flue extension pipe 13, having an internal diameter of for example, 20mm, and which passes through the roof 3 of the caravan into the pressure reduction device 14. The device 14 is roughly a hemispherical dome, more closely an oblate hemispherical dome, with a flat plate immediately above it.

The shielding box 7 is provided with a connection pipe 17 which connects the interior of the box 7 with the ambient air outside the caravan. The entrance to the connection pipe 17 is provided with formations 18, which ensure that there will be no reduction of air pressure from the ambient air to the interior of the connection pipe 17 under draughty conditions. The arrows 19 indicate the direction of flow of air during operation of the burner 6. The pressure reduction device 14 acting together with formations 18 ensure that no reversal of this direction will occur, even under draughty conditions (a reversal would immediately extinguish the flame of the burner means 6).

Furthermore, since the shielding box 7 substantially totally encloses the burner means 6 and is connected to ambient air by the connection pipe 17, a reduction of pressure in the interior of the caravan will not cause the same reduction of pressure in the interior of the shielding box 7. This is ensured by the presence of the connection pipe 17 and additionally by the formations 18 as described. This is important because when towing a caravan, or in a parked caravan if side wall windows are left open, the flow of air past the side wall windows or ventilating openings can cause a considerable reduction of pressure inside the caravan, and this has caused problems to caravaners because with conventional refrigerators, the burner inlet is located inside the caravan, and the flame is put out under those circumstances.

It must be added that small apertures in the shielding box 7 providing communication of the interior thereof, with the interior of the caravan, may be unavoidable, e.g. for the purpose of facilitating lighting up of the burner means 6. Providing, however, that these apertures are relatively smaller than the connection means 17, they should not cause any serious difficulties. If necessary, such apertures can be provided with lids or flaps or the like.

The pressure reduction means 14 is constructed so as to operate by a venturi effect irrespective of the direction of draughts and this device will be more fully described with reference to FIG. 2.

As shown in FIG. 2, the pressure reduction device 14 comprises a dome 21, which is mounted flush on top of the roof 3 of the caravan. The upper surface 22 of the dome 21 is perforated, e.g. with a grid-like perforation and the dome 21 is surmounted by a circular flat plate 23. The dome and all its components are likewise of circular shape in plan view, and moreover constitute symmetrical solids of revolution so as to provide a venturi effect from whatever direction the wind or draft may blow. The fact that the dome 21 is mounted flush on the caravan roof 3 tends to result in wind having relatively small vertical components of velocity and being substantially horizontally orientated. To the extent that this is not so, however, the flat plate 23 effectively eliminates such vertical components of wind velocity as might prevent the pressure reduction action of the device. This is important in one particular context. This arises when the dome 21 is mounted near the edge 24 of the caravan roof. Under these circumstances, there is a tendency for vortex eddies to be generated, which can exert substantial downward components of velocity to the air movement. Were it now for the plate 23, these could nullify or reverse the pressure reduction action which it intended for the dome 21. The interior of the dome 21 is further provided with an umbrella like formation 25 and an aperture 26 passes through the caravan roof 3 and communicates with a junction box 27 which provides an elbow connector 28 for connection to the upper end of the flue extension pipe 13. Thus, airflow through the device as indicated by the arrows 29, cause a reduction of pressure from the ambient air pressure to the interior of the dome 21 by the action of the well-known venturi principle.

Drainage holes 53 are provided. It is to be noted that the pressure reduction effect is achieved regardless of the direction in which the wind blows, and moreover in the absence of any movable part.

FIG. 3 illustrates one alternative pressure reduction means which could be employed in substitution of the dome device 14. This is a venturi 30, which is pivotally mounted on the top end of a pipe nipple 31, which projects above the caravan roof and which communicates with the flue extension pipe 13. The venturi 30 is furthermore provided with a vane 30*a* which is designed in terms of area to cause the venturi 30 to always turn so that its mouth 32 is pointed upwind. Hence, the draughts flowing through the venturi 30 cause a reduction of pressure at the nipple 31 in the desired manner.

The means adapted to prevent any reduction of pressure from the ambient air to the connection pipe 17 can be any one of the alternative devices shown in FIGS. 4*a*, 4*b* through to 8*a*, 8*b*.

Referring first to FIGS. 4*a* and 4*b*, the pipe 17 is provided with the formation 18 at its end 35, which pipe end 35 projects outside the caravan wall into the ambient air. The formation 18 comprises simply two flat plates 33 and 34, which intersect with each other and are orientated in cross-formation as shown. The plates 33, 34 project into the pipe 17 for a distance which may be in excess of the diameter of the pipe 17 as shown. However, it is essential that the crossed plates 33, 34 project beyong the end 35 of the pipe 17 and the preferred distance of projection is approximately equal to a diameter of the pipe 17, as shown.

In FIGS. 4*a* and 4*b*, the ends of the plates 33 and 34 are shown rounded off, but this is merely for convenience to avoid sharp corners and if desired, they could also be of rectangular shape as is indicated by the dotted lines 36.

Referring to FIGS. 5*a* and 5*b*, a similar means is illustrated in that within the pipe 17, flat plates are arranged in the same way as in FIGS. 4*a* and 4*b*, but outside the pipe 17, the flat plates are both slit into four tabs 36, 37, 38 and 39, each of which is bent at an angle in this example of approximately 45° to the longitudinal axis of the pipe 17, as shown. Alternatively, the four tabs can be directed at an angle of between 60° and 30° to the longitudinal direction of pipe 17.

Referring to FIGS. 6*a* and 6*b*, the device there shown is the same as the device shown in FIGS. 5*a* and 5*b* with the exception that the four projecting tabs 39, 40, 41 and 42 are of curved shape rather than the straight shape of the tabs 36, 37, 38 and 39 shown in FIGS. 5*a* and 5*b*.

Again, the ends of the four tabs in both FIGS. 5*a*, 5*b* and 6*a*, 6*b* could be curved or rounded instead of rectangular, if desired.

Referring to FIGS. 7*a* and 7*b*, the pipe 17 is here provided with a truncated hollow cone 43 having a hole 44 as shown. The cone 43 is held in the position shown in the mouth 35 of the pipe 17 by means of struts 45, which do not obstruct the air flow. An important aspect of the mounting of the cone 43 is that the hole 44 must be located inside of the mouth 35 of the pipe 17. For convenience of illustration, FIG. 7*b* is shown here as an axial cross-sectional elevation. The straight sided cone shown could be substituted for by a trumpet shaped cone. FIGS. 8*a* and 8*b* illustrate a similar device to that shown in FIGS. 5*a* and 5*b* with the exception that the end of the pipe 17 is provided with four saw-tooth type serrations. The intended portions 46 of the saw-tooth formation are oriented to be opposite each of the tabs 47, 48, 49 and 50, respectively. In all cases of FIGS. 4*a*, 4*b* through to 8*a*, 8*b*, the devices shown can conveniently be fabricated in sheet metal.

In all cases, the devices ensure that irrespective of the direction of a draught at the mouth of the pipe 17, any reduction of the pressure from the ambient air to the interior of the pipe 17 is prevented. Generally, a positive pressure will be generated.

Referring to FIG. 9, an ante chamber 51 is illustrated as having been introduced in the means which is otherwise as shown in FIG. 1. In FIG. 9, only the part of the means shown in FIG. 1 is illustrated. Thus, the connection pipe 17 which passes through the caravan side wall 4 and is provided with the formation 18, furnishes communication for the ambient air outside the caravan with the interior of the ante chamber 51. As shown in FIG. 9, the ante chamber includes an inlet passage of a given cross section in communication with connection pipe 17, and an expansion chamber of abruptly larger cross-section than the inlet passage. The ante chamber 51 communicates with the shielding box 6 by means of an aperture 52 which should be below the level of the lamp. The shielding box 6 communicates with the funnel 8 and the flue 9, and has the burner 7 located therein, the means being otherwise shown in FIG. 1.

As already mentioned, the provision of the ante chamber provides some damping of sudden pressure variation outside the caravan, such as may be occasioned by severe gusting of wind, so as to provide protection against such effects as putting the flame of the burner 7 out.

What is claimed is:

1. An absorber type refrigerator having a burner means adapted to burn a fuel with air, which comprises shielding means adapted to substantially totally enclose the burner means to inhibit adverse effects of draughts upon the burner means, a flue leading upwards from the shielding means and having an upper exit to the ambient air provided with means adapted to produce a reduction of pressure from the ambient air, inlet connection means adapted to provide access for the ambient air to the interior of the shielding means, and means at the entrance of the inlet connection means adapted to prevent any reduction of pressure from the ambient air to the interior of the inlet connection means in draughty conditions of the ambient air, in which the means adapted to prevent pressure reduction at the entrance to the inlet connection means comprises at least one flat plate centrally spanning the interior of the connection means and projecting out of the entrance of the connection means into the ambient air, said plate being oriented substantially vertically.

2. An absorber type refrigerator as claimed in claim 1, in which the inlet connection means comprises a pipe in communication with the shielding means and the means adapted to prevent pressure reduction at the entrance to the inlet connection means comprises two intersecting substantially orthogonally oriented flat plates located in the entrance to the pipe and projecting out of the entrance into the ambient air, the pipe being elongated in a longitudinal direction, at least the portion of the plates wholly inside the pipe intersecting along a line substantially parallel with the longitudinal direction of the pipe.

3. An absorber type refrigerator as claimed in claim 2, with the portions of the flat plates projecting outside the inlet connection means forming four tabs directed at an angle of between 60° and 30° to the longitudinal direction of the inlet connection means.

4. An absorber type refrigerator as claimed in claim 1, which includes an ante chamber interposed between the inlet connection means and the shielding means for damping abrupt pressure changes from the ambient air to the interior of the shielding means, said ante chamber comprising an inlet passage of a given cross section, an expansion chamber of abruptly larger cross section and an outlet passage from the expansion chamber to the shielding means.

5. An absorber type refrigerator as claimed in claim 1, which includes a water trap in the flue for collecting moisture which may form in the flue and preventing the moisture from falling onto the burner means, said water trap including drain means adapted to dispose of trapped moisture.

6. An absorber type refrigerator as claim in claim 1, wherein the portions of the at least one flat plate projecting outside the connection means comprise four tabs curved radially outward relative to the longitudinal direction of the connection means.

7. An absorber type refrigerator as defined in claim 3, wherein the inlet connection means comprises a pipe provided with four saw-tooth serrations at its entrance with each serration oriented to be opposite one of the tabs.

8. An absorber type refrigerator having a burner means adapted to burn a fuel with air, which comprises shielding means adapted to substantially totally enclose the burner means to inhibit adverse effects of draughts upon the burner means, a flue leading upwards from the shielding means and having an upper exit to the ambient air provided with means adapted to produce a reduction of pressure from the ambient air, inlet connection means adapted to provide access for the ambient air to the interior of the shielding means, and means at the entrance of the inlet connection means adapted to prevent any reduction of pressure from the ambient air to the interior of the inlet connection means in draughty conditions of the ambient air, in which the inlet connection means comprises a pipe in communication with the shielding means and the means adapted to prevent pressure reduction at the entrance to the inlet connection means comprises two intersecting substantially orthogonally oriented flat plates located in the entrance to the pipe and projecting out of the entrance into the ambient air, the pipe being elongated in a longitudinal direction, at least the portion of the plates wholly inside the pipe intersecting along a line substantially parallel with the longitudinal direction of the pipe.

9. An absorber type refrigerator having a burner means adapted to burn a fuel with air, which comprises shielding means adapted to substantially totally enclose the burner means to inhibit adverse effects of draughts upon the burner means, a flue leading upwards from the shielding means and having an upper exit to the ambient air provided with means adapted to produce a reduction of pressure from the ambient air, a water trap in the flue for collecting moisture which may form in the flue and preventing the moisture from falling onto the burner means, said water trap including drain means adapted to dispose of trapped moisture, inlet connection means adapted to provide access for the ambient air to the interior of the shielding means, and means at the entrance of the inlet connection means adapted to prevent any reduction of pressure from the ambient air to the interior of the inlet connection means in draughty conditions of the ambient air.

10. An adsorber type refrigerator having a burner means adapted to burn a fuel with air, which comprises sheilding means adapted to substantially totally enclose the burner means to inhibit adverse effects of draughts upon the burner means, a flue leading upwards from the shielding means and having an upper exit to the ambient air provided with means adapted to produce a reduction of pressure from the ambient air, inlet connection means adapted to provide access for the ambient air to the interior of the shielding means, and means at the entrance of the inlet connection means adapted to prevent any reduction of pressure from the ambient air to the interior of the inlet connection means in draughty conditions of the ambient air, said means adapted to prevent any reduction of pressure comprising flat plates projecting outside the connection means, and portions of said flat plates comprising four tabs curved radially outward relative to the longitudinal direction of the connection means.

11. An absorber type refrigerator having a burner means adapted to burn a fuel with air, which comprises shielding means adapted to substantially totally enclose the burner means to inhibit adverse effects of draughts upon the burner means, a flue leading upwards from the shielding means and having an upper exit to the ambient air provided with means adapted to produce a reduction of pressure from the ambient air, inlet connection means adapted to provide access for the ambient air to the interior of the shielding means, and means at the entrance of the inlet connection means adapted to prevent any reduction of pressure from the ambient air to the interior of the inlet connection means in draughty conditions of the ambient air, in which the means adapted to prevent pressure reduction from the ambient air to the interior of the inlet connection means comprises a truncated hollow cone mounted at the entrance having a smaller truncation hole located inside the entrance and a larger truncation hole located outside the entrance, said truncated hollow cone having its walls spaced from the entrance to the inlet connection means to provide air passages into the inlet connection means both outside and inside the walls of said cone.

12. An absorber type refrigerator as defined in claim 9, in which the means adapted to prevent pressure reduction from the ambient air to the interior of the inlet connection means comprises a truncated hollow cone mounted at the entrance having a smaller truncation hole located inside the entrance and a larger truncation hole located outside the entrance, said truncated hollow cone having its walls spaced from the entrance to the inlet connection means to provide air passages into the inlet connection means both outside and inside the walls of said cone.

* * * * *